United States Patent [19]

Hammond et al.

[11] 4,080,731

[45] Mar. 28, 1978

[54] APPARATUS FOR SINGLING OUT AND SERIALLY FEEDING ELECTRICAL LEADS

[75] Inventors: James Woodrow Hammond, Camp Hill; Mervin Leonard Shughart, Carlisle, both of Pa.

[73] Assignee: AMP Incorporated, Harrisburg, Pa.

[21] Appl. No.: 742,719

[22] Filed: Nov. 17, 1976

Related U.S. Application Data

[62] Division of Ser. No. 628,028, Nov. 3, 1975, abandoned.

[51] Int. Cl.[2] ..... H01R 43/04

[52] U.S. Cl. ..... 29/715; 29/628; 29/753; 29/759; 198/475; 198/548; 198/671

[58] Field of Search ..... 29/628, 630 R, 630 A, 29/714, 715, 753, 759, 748; 221/75, 277; 198/209, 213, 475, 548, 671

[56] References Cited

U.S. PATENT DOCUMENTS

| | | | |
|---|---|---|---|
| 3,245,135 | 4/1966 | Netta et al. | 29/630 A |
| 3,263,316 | 8/1966 | Schrader | 29/753 X |
| 3,456,324 | 7/1969 | Hahn et al. | 29/715 |
| 3,879,832 | 4/1975 | Fidiam | 29/715 |
| 3,883,939 | 5/1975 | Wion | 29/715 |

*Primary Examiner*—Carl E. Hall
*Attorney, Agent, or Firm*—Gerald K. Kita

[57] ABSTRACT

A hopper funnels a plurality of electrical leads one on top the other and serially drops the leads onto a rotating cylindrical feed roller. The roller is provided with a helical groove which picks off individual leads and transports them transversely of their lengths along the top of the cylindrical roller. The pitch of the groove determines the spacing between transported leads. The roller simultaneously projects each lead lengthwise toward a sensing device which senses the end of each lead in turn and also triggers an applicator which connects an electrical contact to each sensed lead. The leads are then transported along the roller to an escapement station at the end of the roller where the leads escape by gravity to a collection area. An ejectment mechanism initially detains each lead from the escapement station until connected with a contact. The ejectment mechanism positively ejects each lead toward the escapement station.

19 Claims, 7 Drawing Figures

APPARATUS FOR SINGLING OUT AND SERIALLY FEEDING ELECTRICAL LEADS

This is a division of application Ser. No. 628,028, filed Nov. 3, 1975, now abandoned.

FIELD OF THE INVENTION

The present invention relates to a method and apparatus for singling out electrical leads and for properly positioning the leads in turn within an applicator which connects corresponding electrical contacts to the leads.

BACKGROUND OF THE PRIOR ART

Connecting electrical contacts to corresponding electrical leads by crimping is accomplished in the prior art by a machine applicator. By some manner the leads must be suitably positioned in turn between the jaws of the applicator such that closure of the jaws cold forges or crimps contacts onto corresponding leads. In the prior art leads are individually positioned by hand. Hand positioning of each lead is time consuming thus limiting the number of completed terminations per hour capacity of an applicator. Guards on the applicator required to protect an operator, interfere with placement of the leads. An operator is required to poke each lead through a restricted opening of a guard and then position the lead while looking through the guard. Machines for automatically supplying leads to an applicator have been devised. In such machines each lead is clamped to a conveyor or is laid within a groove of a conveyor. The conveyor conveys each lead sideways or endwise toward an applicator which connects an electrical contact thereto. Several disadvantages are inherent in this type machine. Each wire end must be pre-positioned in the conveyor to insure proper presentation to the applicator. The conveyor often requires excessive floor space. Separate operations are required to separate the leads and to feed the leads into an applicator and to release the leads after connection of the electrical contacts.

SUMMARY OF THE INVENTION

The present invention utilizes a single drive roller which separates wires or leads one from the other and also properly positions each lead in turn for connection of an electrical contact thereto. Each lead is fed by gravity onto registration with the drive roller. A helical groove in the drive roller is of a depth and width to pick off the leads individually. As the roller rotates the leads are separated from one another a distance equal to the pitch of the helical groove. Each lead is transported longitudinally and also transversely of its length along the top of the roller to an applicator station. The roller projects the leads longitudinally in turn between the jaws of an applicator which cold forges, or crimps, an electrical contact to each lead end. The roller then transports each terminated lead to an escapement station at the end of the roller where the lead escapes by gravity. The relatively small amount of space required for the roller eliminates lenghtly transport and wide separation of the lead. The application rate of the applicator is regulated advantageously be varying the rotational speed of the roller.

According to one mode of operation, a lead end in proper position at the applicator triggers a sensing device which activates the applicator. The roller continuously supplies new leads to the applicator for continuous operation. According to another mode of operation the sensing device is used to brake the roller. Transport of the lead is stopped until cycling the applicator. The roller is restarted either by the sensing device or by an operator. The restarted roller transports the terminated lead to the escapement station and also transports another lead to the applicator station. According to this mode of operation transport of the leads to the applicator station is intermittent.

Since the leads are automatically positioned in the applicator, the applicator jaws and the feed or transport mechanism may be completely surrounded by protective guards safely isolating the applicator from a human operator.

OBJECTS

Accordingly an object of the present invention is to provide a method and apparatus for transporting and positioning electrical leads sequentially to an applicator enabling complete shielding of the applicator from a human operator.

Another object of the present invention is to provide a method and apparatus for automatically singling out and transporting individual electrical leads both lengthwise and transversely of their lengths to an applicator and an escapement station.

Another object of the present invention is to provide a method and apparatus for singling out and serially transporting electrical leads to an applicator where such lead is momentarily detained until actuation of the applicator connects an electrical contact to the lead.

Another object of the present invention is to provide an electrical lead feeding mechanism having a cylindrical roller provided with a helical groove which receives individual leads and transports the leads serially to a sensing device which brakes the roller during actuation of an applicator which connects an electrical contact to each sensed lead.

Another object of the present invention is to provide a feed mechanism for electrical leads which feeds individual leads both longitudinally and transversely of their lengths to an applicator station where a gate momentarily detains transport of each lead in turn until after connection thereto of a corresponding electrical contact by an applicator.

Other objects and many attendant advantages of the present invention will become apparent upon perusal of the following detailed description taken in conjunction with the accompanying drawings.

DESCRIPTION OF THE DRAWINGS

With more particular reference to FIGS. 1, 2 and 3 of the present invention there is illustrated generally at 1 an apparatus for singling out and serially feeding electrical leads or wires. The apparatus includes a base plate or table 2 having attached thereto a sidewall 3 and an endwall 4. A synchronous motor 6 is mounted to the sidewall 3. An output shaft 8 of the synchronous motor projects outwardly from the motor housing 10 and has mounted thereover an enlarged cylindrical drive roller 12. The cylindrical surface of the roller is provided thereover with a helical groove 14 the profile of which is arcuate, and the pitch of which is relatively large in dimension as indicated in FIG. 1 at P. The groove includes a right cylindrical portion 15 which is not helical but is perpendicular with the axis of rotation. The endwall or end plate 4 is provided with an enlarged right angle cutout or relieved portion 16. A motor cover plate illustrated generally at 18 has one side edge 20 engaged on the cutout portion 16. The cover 18 is formed with an arcuate portion 22 generally encircling the motor housing 10 and, continuous with a horizontal portion 24 which forms a table for a purpose to be described. The horizontal table portion 24 extends continuously to an inclined sidewall portion 28 forming an inclined escapement slide or chute adjacent to a circular end 26 of the roller. The portion 28 then is formed into an inverted wall portion 30 which is bent at 32 for connection with a vertical edge of the base 2. The table portion 24 is slightly recessed below the cylindrical surface of the roller 12 in order to dispose the arcuate profile of the groove 14 above the surface of the table 24. As shown in FIG. 2 the table portion 24 has a side edge 34 which terminates adjacent to the cylindrical roller 12 thereby exposing a top portion of the cylindrical roller and the groove 14. Adjacent the roller 12 a block 36 is mounted in a cutout 38 of the sidewall 3 and projects toward the roller 12. Accordingly the table portion 24 and the block 36 have a top portion of the roller 12 interposed therebetween.

As shown in FIG. 1, the present invention further includes a funneling hopper or chute indicated generally at 40 comprised of a pair of formed plates projecting outwardly of the sidewall 3 and having converging arcuate portions 42 and 44 contiguous with vertical plate sidewall portions 42' and 44' respectively which form a parallel sidewall hopper or chute 46. The plate 42' is welded to a plate 48 and the plate 44' is welded to a cover plate 45 parallel with the plate 48. The bottom of the portion 42' terminates adjacent the top of the roller 12.

As shown in FIGS. 2 and 3, the portion 44' has a bottom edge 50 which terminates in spaced relationship from the roller 12 providing a clearance between the portion 44' and the table portion 24 and also between the portion 44' and the top of the roller 12. A generally circular cutout portion 52 is provided in the portion 44' providing a clearance around a substantially chamfered end 54 of a cylindrical idler roller 56.

As shown more particularly in FIGS. 4 and 5, the roller 56 is rotatably mounted on a fixed shaft 58. The end 60 of the shaft is mounted on one end of a vertical bar 62 of generally T-shaped cross-section. The bar is vertically slidably received between a pair of rails 64 and 66 which are secured by cap screws 68 to a back plate 70. The plate 70 is secured to an inclined sliding block 72 slidably mounted on an inclined and recessed bearing surface 74 of a bearing block 76 which is secured laterally to a mounting plate 77. The bearing surface 74 and the block 72 is thereby recessed within the block 76. An overlying strap 78 secured to the block 76 retains the block 72 slidably in place. Another strap 80 is secured to the plate 77 and has a slot 82 therein which rotatably mounts a reduced neck 84 of an adjustment screw 86. The threaded end 88 of the screw is threadably received in the sliding block 72. As shown in FIG. 3, the plate 77 is mounted by a spacer block 79 against the plate 3. The plate 77 forms a back plate or stop for the chute 46. The plate portion 44' is secured to the slidable block 72. Sliding the block 72 adjusts the width of the chute portion 46 and simultaneously positions the idler roller 56 over the cylindrical roller 12. Rotation of the adjustment screw 86 displaces the plate portion 44' toward and away from the plate portion 42' thus varying the width of the chute portion 46. Simultaneously, the vertical clearance between the idler roller 56 and the roller 12 is adjusted or varied.

Figure 3:
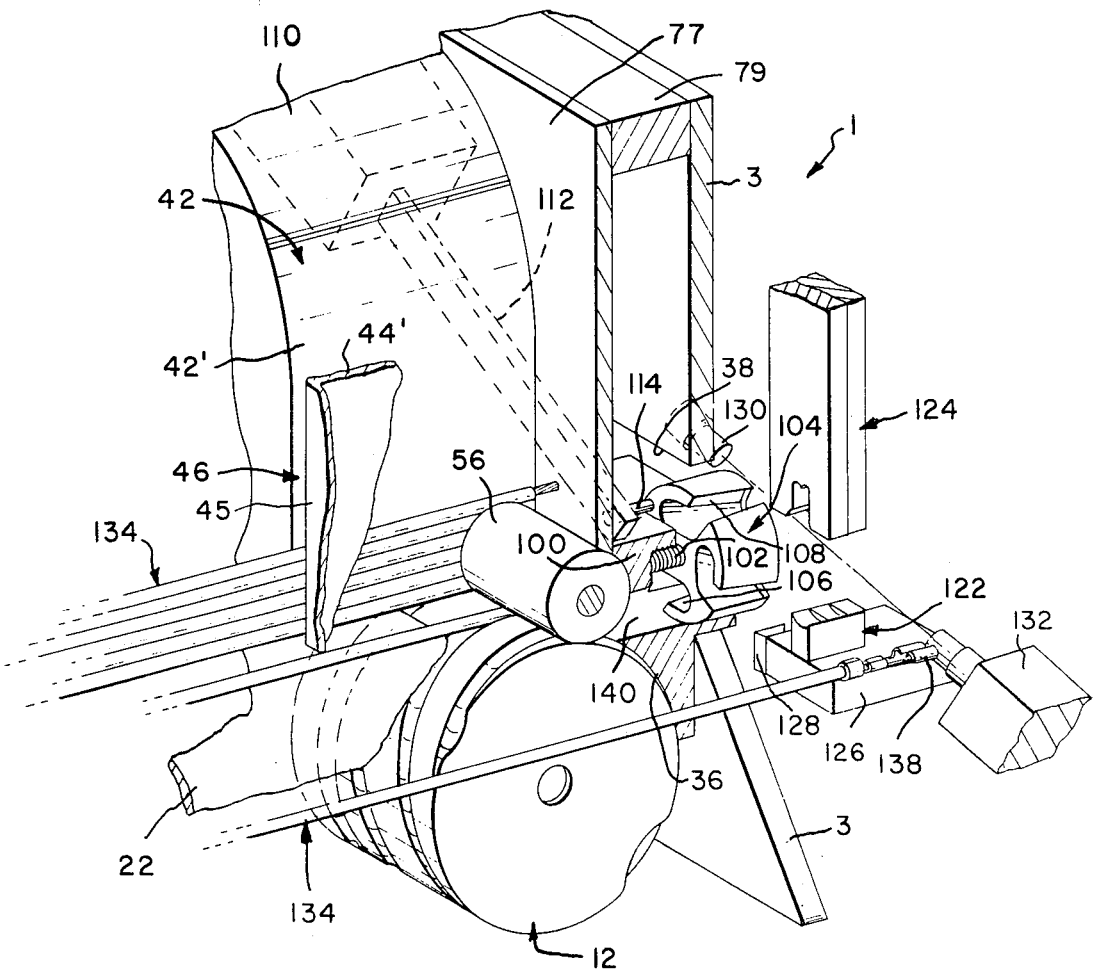
Figure 5:
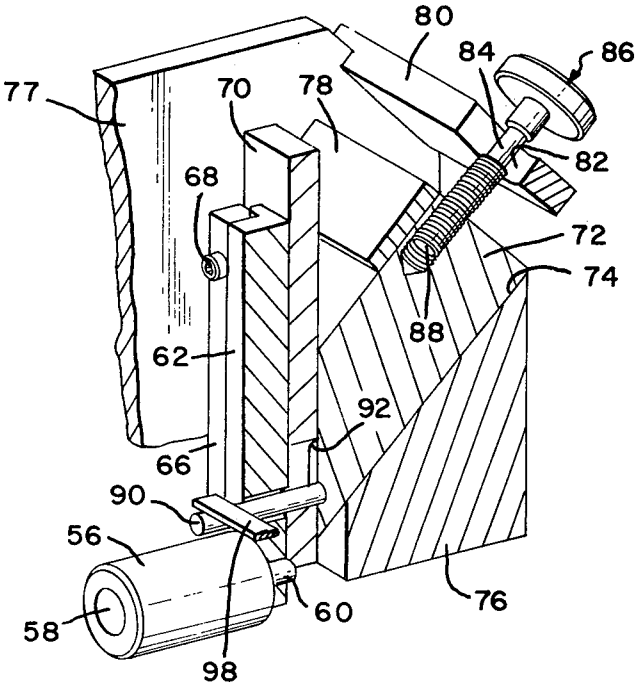
FIGS. 4 and 5 are enlarged fragmentary perspectives of an ejectment or escapement mechanism for the apparatus shown in FIG. 1.
Figure 4:
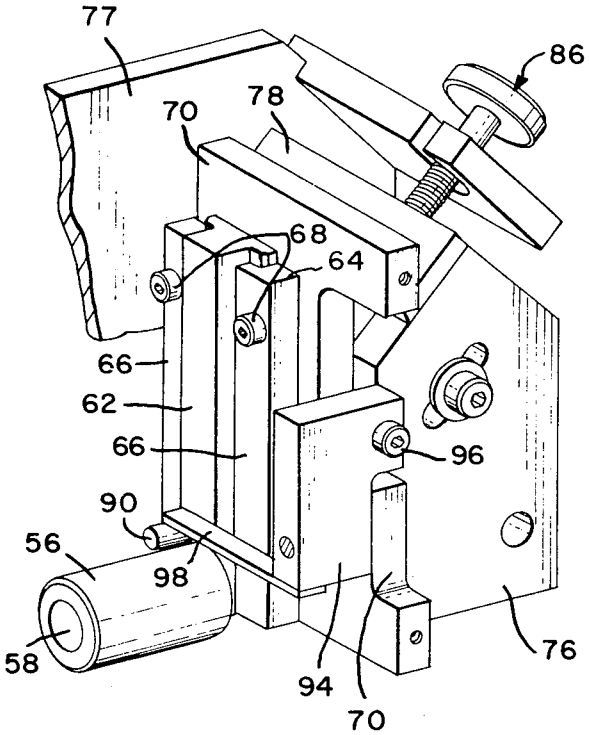

As shown more particularly in FIGS. 4 and 5, the sliding block 62 to which the idler roller 56 is mounted includes a fixed projecting dowel 90. One end of the dowel slidably projects through a vertical slot 92 of the plate 70. A mounting plate 94 is mounted by a cap screw 96 to the edge of the plate 70. A cantilever leaf spring 98 is secured at one end to the plate 94. The free end of the spring resiliently engages against the dowel 90, urging the dowel toward the lowermost portion of the slot 92, and also urging the sliding block 72 and the idler roller 56 downwardly and toward the drive roller 12. It is further illustrated in FIGS. 2 and 3 that the mounting plate 77 is perpendicular to the arcuate portion 42 and the chute portion 42' forming a back stop or stop plate extending immediately behind the idler roller 56.

Figure 2:
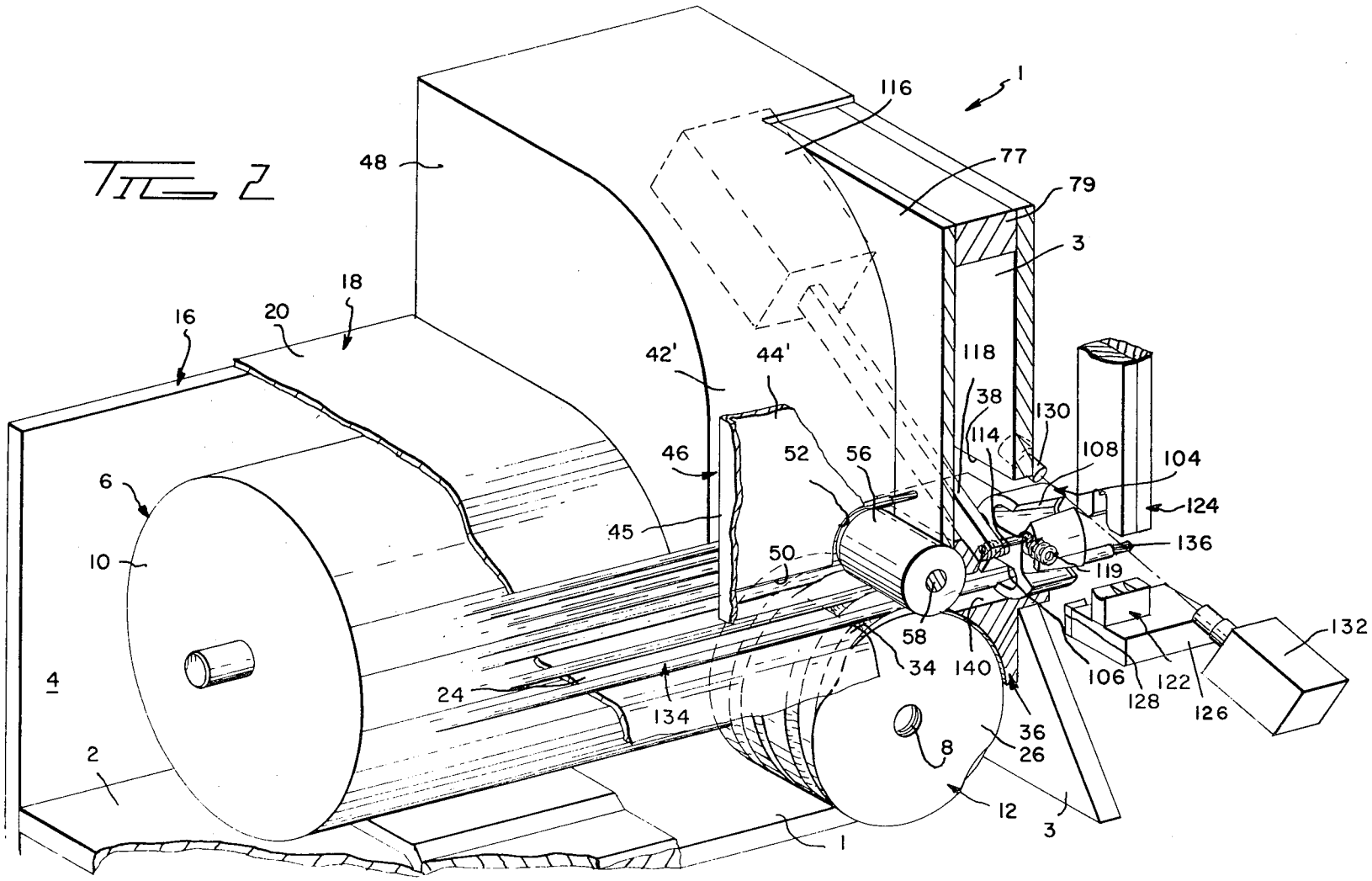
FIGS. 2 and 3 are fragmentary perspectives illustrating different modes of operation of the apparatus shown in FIG. 1.
Figure 6:
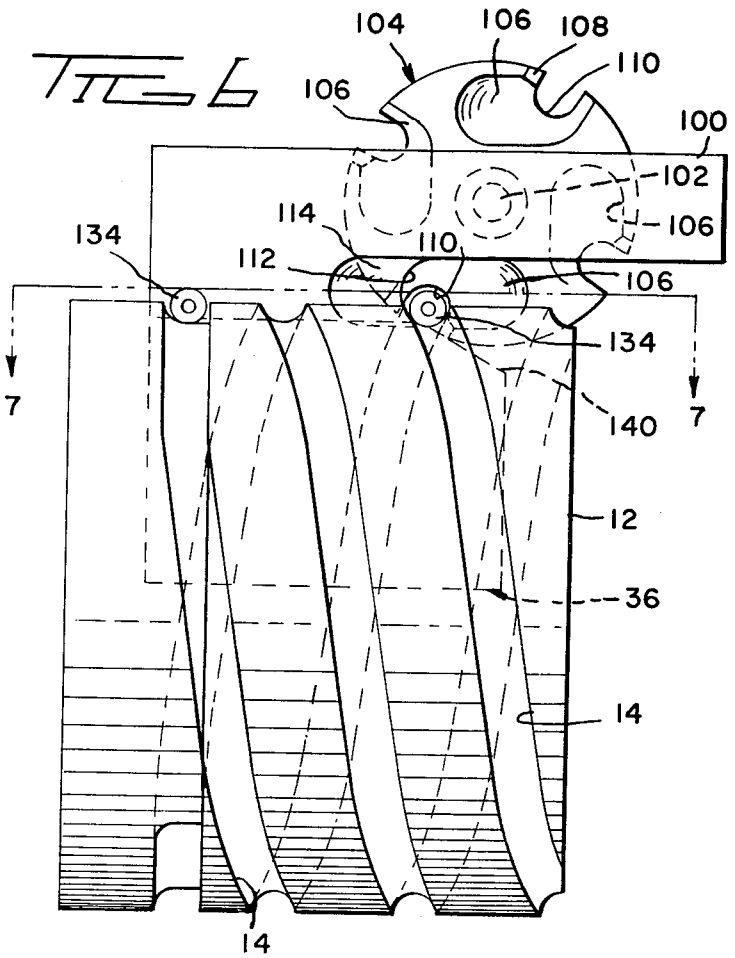
FIG. 6 is a diagrammatic view in elevation illustrating operation of the feeding mechanism according to the present invention.

Yet with reference to FIGS. 2 and 3, the stop plate 77 has mounted laterally thereagainst the block 36. As shown in FIGS. 3 and 6 the block has a horizontally projecting arm portion 100 having threadably mounted thereon an axle 102 on which is rotatably mounted a generally cylindrical turret 104. The turret 104 is more particularly shown in FIGS. 2, 3 and 6 and includes a cylindrical block, provided with a plurality of passageways 106 each of which is in the form of a relatively deep funnel shaped groove in the cylindrical surface of the turret and extending between the circular ends of the turret. Each groove has an arcuate bottom and a leading corner 108 which is chamfered.

As shown in FIG. 6, the turret is positioned on the arm portion 100 such that one of the passageways 106 has its narrower end 110 in alignment with the helical groove 14 of the drive roller 12. A passageway 112 in the block 36 is provided under the arm portion 100 and is defined by an arcuate concave and tapered undercut sidewall 114. The narrower end 110 of the turret passageway 106 is in tandem alignment with the groove 14 and the passageway 112.

According to one embodiment, the turret 104 is rotated counterclockwise by a solenoid shown in phantom outline in FIG. 2 at 116. The solenoid is advantageously mounted on the back plate 77 with the solenoid armature 118 projecting diagonally toward the turret 104. A pin 114 connects the solenoid armature with the turret 104 at a location radially spaced from the turret axle 102. Thus upon actuation of the solenoid in the well known manner the armature will forcibly pivot the turret 104 counterclockwise as shown in the drawings. The solenoid is of the single action type requiring a return spring to reset the solenoid and to rotate the turret clockwise. The return spring is illustrated at 119 in FIGS. 1 and 2 and has one end connected to the pin 114 and the other end connected to a pin 120 contained within an opening 121 of the block 76.

Figure 1:
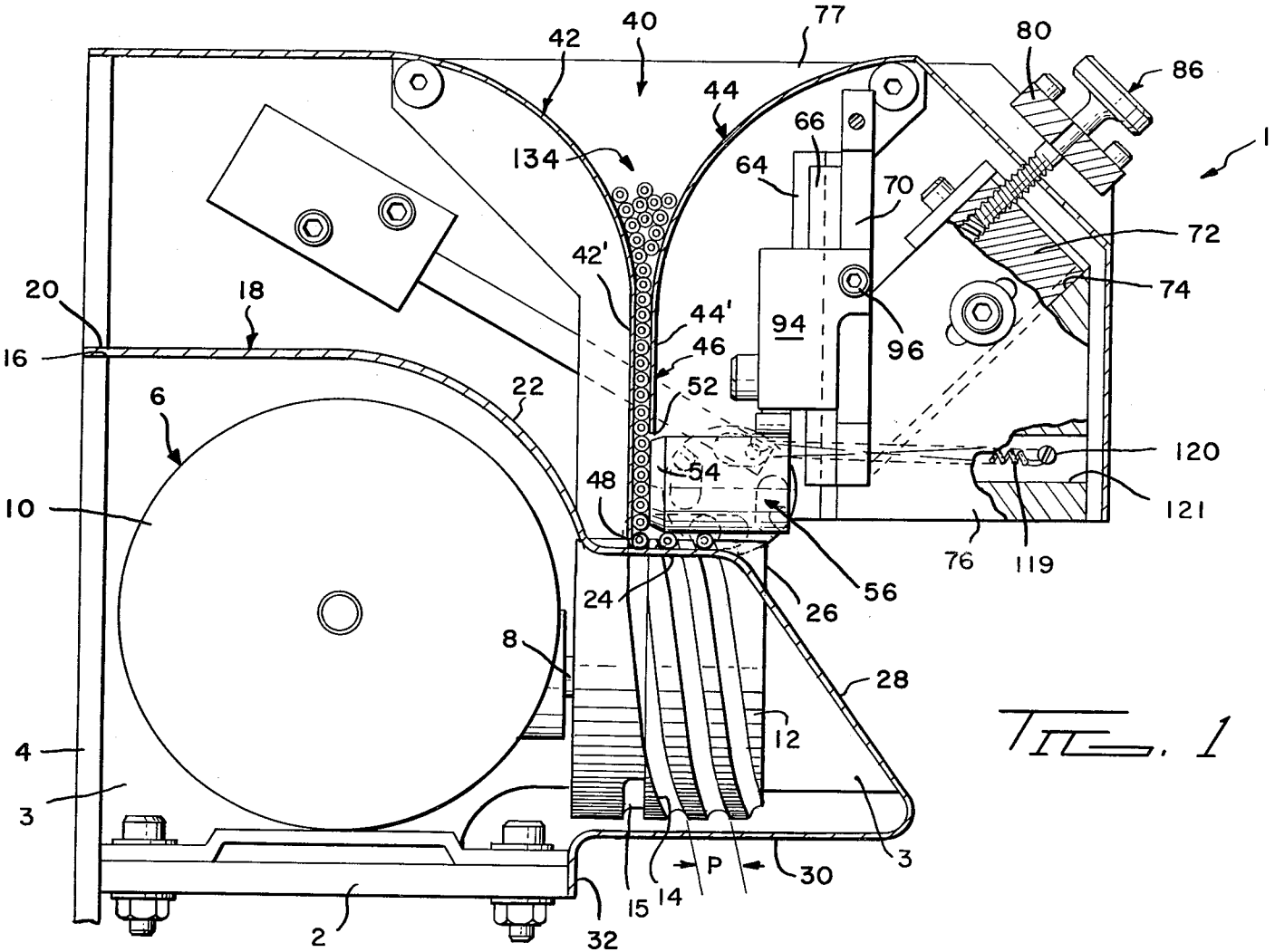
FIG. 1 is a fragmentary elevation with parts broken away and with parts in section illustrating a wire feeding mechanism according to the present invention.
Figure 7:
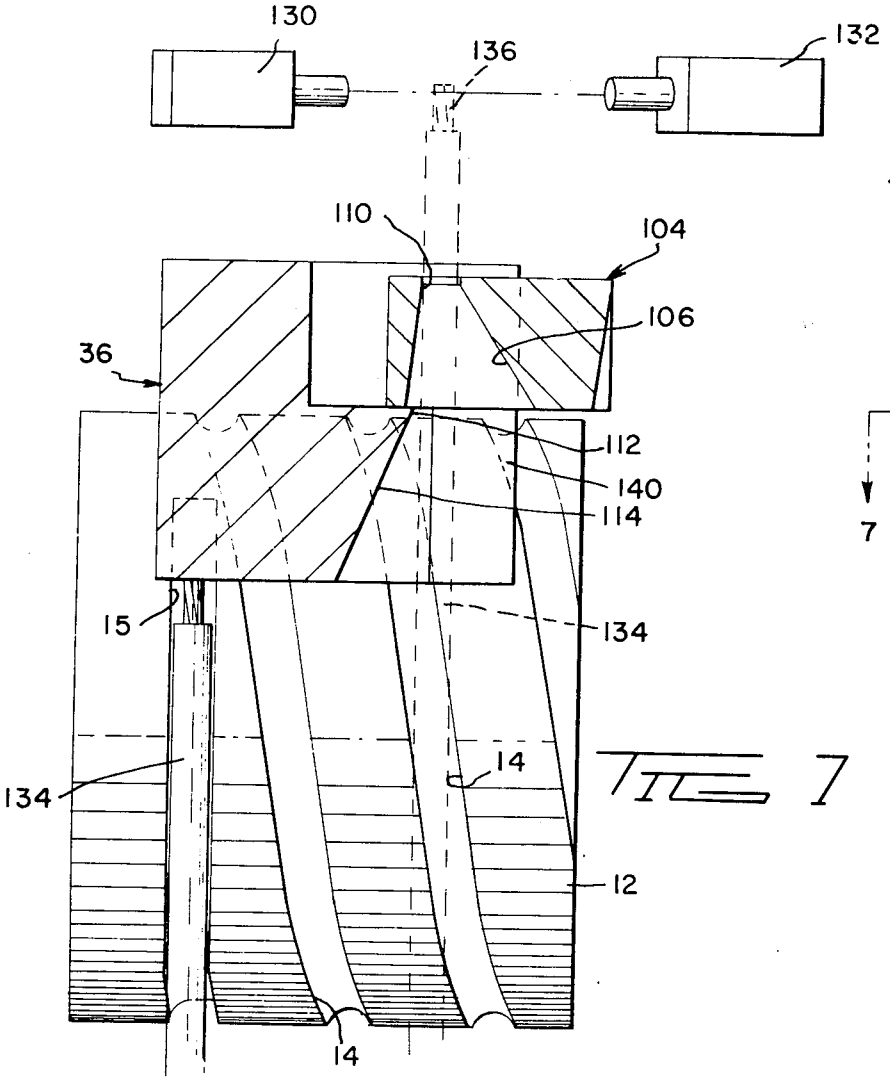
FIG. 7 is a diagrammatic view in plan of the apparatus illustrated in FIG. 6.

As shown more particularly in FIGS. 2 and 3 the turret opening 106 is in line with a space defined between a pair of jaws 122 and 124. The jaw 122 is fixedly mounted on an anvil 126 of an applicator of any type well known in the prior art. The jaw 124 is reciprocably mounted on a ram of an exemplary prior art applicator for motion toward and away from the fixed jaw 122. For clarity the entire applicator is not illustrated. The jaw 122 is provided with a sensor 128 which advantageously may be a proximity switch. The sensor 128 may also be any kind of electromechanical or lever switch available in the prior art. The sensor provides a switch to turn on the motor 6 which drives the roller 12. As shown in FIGS. 1, 2 and 7, a light beam source 130 projects a beam of light so as to intercept the path of the passageway portion 110. The beam of light is intercepted by a photovoltaic cell 132 used as a switch to turn off the motor 6 when the light beam is interrupted. The source 130 and the cell 132 are mounted to the device in any desired manner. The distance of the light beam from the turret may be varied as desired.

In operation, adjustment of the set screw 86 adjusts the width of the chute 46 and more particularly displaces the plate portion 44' toward and away from the plate portion 42'. This is done to accommodate wires of different widths. Simultaneously the idler roller 56 becomes adjusted in its vertical position to define a preset clearance between it and the drive roller 12 for accommodating wires of different widths. A bundle of electrical leads 134, typically insulation covered wires, is supplied by hand to the funnel shaped hopper portion 40. The wire ends 136 typically have been previously exposed by stripping away portions of the insulation. The exposed wire ends are disposed in engagement against the stop plate 77. The narrow width chute 46 serially arranges the wires allowing them to fall by gravity onto the right cylindrical groove portion 15 of the drive roller 12. The foremost wire presented to the drive roller is frictionally engaged in the recessed surface of the groove. Rotation of the drive roller 12 clockwise as shown in FIG. 3 transports the foremost wire along the top of the roller within the groove 14. The foremost wire or lead is frictionally pinched between the idler roller and the drive roller 12, with the spring 98 urging the idler roller 56 into engagement on the wire. The chamfered end 54 of the idler roller 56 funnels the wire between the rollers 12 and 56. As the wire is transported transversely of its length from left to right the drive roller 12 simultaneously projects or transports the wire longitudinally of its length. More particularly, as shown in FIG. 7, the foremost wire 134 is projected forwardly endwise or longitudinally until its end 136 engages against the front planar surface of the block 36. The block inhibits additional longitudinal displacement of the wire as the wire is transported transversely of its length along the top of the roller. Slippage of the groove along the wire will occur until the wire is transported a distance sufficient to reach the undercut sidewall 114. When the wire reaches the undercut sidewall 114, the wire becomes free of the block front face and is permitted to be transported longitudinally to project through the aligned passageways 112 and 110. It will be apparent that the block front face in cooperation with the roller 56 serves as a confining means which confines the wire being conveyed laterally or transversely of their axes until they are fed longitudinally by the drive roller 12. As shown in FIG. 7 the passageways 112 and 106 funnel and thereby guide the wire end 136 to project the same outwardly of the passageway 110. As the wire end 136 is projected outwardly of the passageway 110, it interrupts the light beam emanating from the source 130, thus shutting off the motor and ceasing further rotation of the drive roller 12. The motor is advantageously of the braking type whereby further transport of the wire 134 is immediately interrupted. The wire end 136 is thereby stationary and held in place by the cooperating rollers 12 and 56. The stationary wire end is now suitably positioned between the jaws 122 and 124 such that closure of the jaws will crimp a corresponding electrical terminal 138 on the wire end. When the motor is observed to shut off closure of the jaws is effected by an operator manually cycling the applicator in any well known manner. Alternatively the applicator may be cycled electrically by a signal supplied by the photovoltaic device 132. Thus cycling the applicator is accomplished simultaneously with braking the motor 6. Complete closure of the jaws must occur after or simultaneous with the wire becoming stationary.

Complete closure of the jaws is sensed by the sensor 128 which originates electrical signals to turn on the motor and to activate the solenoid 116. Turning on the motor restarts the drive roller which transports another electrical lead into position between the applicator jaws and into position to interrupt the light beam. Activating the solenoid rotates the turret counterclockwise as shown in FIG. 3, the turret sweeping the lead terminated with the contact 138 outwardly away from the end of the drive roller and along a vertically inclined surface 140 of the block 36. Thereafter the terminated lead falls by gravity out the groove passageway of the turret and downwardly along the surface 140 which forms an escapement station at the end of the roller 12. The turret thereby serves as a gate detaining momentarily each lead in turn from the escapement station until the turret is rotated at which time the turret forcibly ejects each of the leads to the escapement station. In the device as shown, both the solenoid 116 and the turret are reset by the return spring 119. The turret is thus rotated clockwise to reposition the passageway 106 in alignment with the passageway 112 as shown in FIG. 7. However, it should be understood that the turret may also be rotated only in one direction counterclockwise such that another passageway 106 of the turret is suitably positioned in alignment with the passageway 112. In this case, the solenoid alone is reset, and the solenoid armature 112 must be linked so as to slide with respect to the turret.

According to another mode of operation the drive roller 12 continuously rotates. With each rotation the groove 14 singles out individual leads 130 from the chute 46, spacing individual leads transversely from one another across the top of the drive roller 12 a distance equal to the pitch of the groove 14. The spacing between the wires allows sufficient time for repeated opening and closing of the turret or gate in time to receive another lead supplied to it by the roller. Each revolution of the roller singles out another wire or lead from the chute 46 and ejects a corresponding terminated lead 130. If the roller is rotated at 60 RPM, then 3600 leads per hour are terminated with corresponding electrical contacts 132. The applicator as well as the moving parts of the wire feeding device are completely covered by the plates 18, 48, 42, 45 and 77 which serve as barriers or guards completely shielding an operator of the feeding mechanism. Only the funneling device 40 protrudes exposing the narrow chute 46 which is of a width of one-fourth inch or less which provides wire access to the roller 12 but prevents the intrusion of an operator's finger.

According to another feature of the present invention as shown with reference to FIG. 6, precise positioning of the wire ends or leads within the hopper 40 is not required. The back plate 77 limits placement of the wire ends. However the wire ends need not be engaged against the back plate 77 and may in fact be considerably short of the back plate when presented to the drive roller 12.

In some instances the roller may pick off leads whose ends initially are spaced from the back plate 77. Yet the roller 12 will drive each of such leads longitudinally into the aligned passageways 112 and 110. As shown in FIG. 7, longitudinal transport of each lead is large by comparison to lateral or transverse transport. Each lead picked off by the grooved roller 12 is thereby quickly projected longitudinally so as to project through the passageways 114 and 110. Some leads may be projected longitudinally into the passageways without first engaging the front face of the block 36. Other leads may have to be restrained against the front face of the block 36 until they are transported sufficiently laterally until each of their respective positions position in the groove 14 is in alignment with the passageways 112 and 110. At this position, the large longitudinal transport produced by the roller 12 will project the lead into the position shown in FIG. 7. Accordingly as long as the roller 12 picks off a lead, the wire feeding apparatus will correctly position the lead in the applicator jaws without regard to initial positioning of the lead upon presentation to the apparatus.

Although preferred embodiments and modifications of the present invention have been specifically illustrated and disclosed, other modifications and embodiments which would become apparent to one having ordinary skill in the art are intended to be covered by the spirit and scope of the appended claims.

What is claimed is:

1. A wire feeding and electrical contact applicator mechanism, comprising:

a barrier provided with a wire receiving opening of sufficiently small dimensions to prevent insertion of a human operator's finger therethrough, a friction drive, a pair of jaws of an applicator mounted in tandem alignment with said friction drive, said jaws being normally spaced apart and closeable together for cold forging an electrical contact to an electrical wire transported between said jaws by said friction drive, said friction drive including a cylindrical feed roller and a motor for driving said feed roller and an idler roller cooperating with said feed roller to frictionally grip there between an electrical wire supplied by an operator through said electrical wire receiving opening, means on the cylindrical periphery of said feed roller for transporting a wire transversely of its length from said wire receiving opening toward said jaws and for transporting a wire longitudinally into position between said jaws, and means mounted in tandem alignment with said jaws for sensing an electrical wire in position between said jaws and for closing said jaws together to cold forge an electrical contact to the electrical wire in position between said jaws.

2. The structure of claim 1, and further including:

an escapement station, said feed roller being provided with a helical groove frictionally engageable on an electrical wire for transport of the wire longitudinally into position between said jaws and for transport of the wire transversely of its length to said escapement station.

3. The structure of claim 2, wherein, said barrier opening comprises a funnel for serially feeding a plurality of electrical wires to said feed roller, and said helical groove is of a depth and width to frictionally engage a single one of said wires.

4. Apparatus for conveying wires serially laterally of their axes for a predetermined distance and then feeding each wire axially, said apparatus comprising:

a wire conveying and feeding roller having a cylindrical surface, drive motor means for rotating said roller, a wire-receiving groove in said cylindrical surface, said groove extending circumferentially around said roller and towards one end of said roller, confining means extending adjacent to said surface and towards said one end of said roller for confining said wires in said groove, and pressure roller means adjacent to said one end of said roller for applying pressure to a wire disposed in said groove which is adjacent to said one end whereby, upon placing a wire in said groove and upon rotation of said roller, said wire will be conveyed laterally of its axis and towards said one end, and after lateral conveyance, said wire will be fed axially by said roller in cooperation with said pressure roller.

5. Apparatus as set forth in claim 4, said apparatus having loading means for loading said wires into said groove.

6. Apparatus as set forth in claim 4, said groove having an end which is located intermediate the ends of said roller, said groove extending from said end towards said one end of said roller.

7. Apparatus as set forth in claim 6, said groove extending to, and intersecting, said one end of said roller.

8. Apparatus for feeding individual wires to an operating zone, presenting one end of each wire to said zone, and performing an operation, such as crimping a terminal, on each wire in said zone, said apparatus comprising:

a wire conveying and feeding roller having a cylindrical surface, drive motor means for rotating said roller, a wire loading station and a wire axial feeding station, said stations being spaced apart in the direction of the axis of said roller and being proximate to said cylindrical surface, a wire-receiving groove in said cylindrical surface, said groove extending circumferentially around said roller from said loading station to said axial feeding station, wire loading means at said loading station for loading individual wires in said groove with the axes of said wires extending generally tangentially with respect to said cylindrical surface, wire stop means proximate to said cylindrical surface for engaging one end of each wire which is loaded in said groove to prevent axial movement of each wire, said wire stop means extending from a location adjacent to said loading station towards said feeding station whereby, rotation of said roller conveys each wire loaded into said groove laterally of its axis toward said axial feeding station, wire feeding means at said axial feeding station for feeding each wire axially, said wire feeding means comprising portions of said groove, said operating zone being proximate to said roller at said wire feeding station and spaced from said roller in the direction of axial feeding of each wire, said operating zone having operating means therein for performing said operation on each wire, whereby, during continuous operation of said apparatus, wires placed in said groove at said loading station, are moved laterally of their axes to said wire feeding station, are fed axially into said operating zone, and an operation is performed on an end of each of said wires in said operating zone.

9. Apparatus as set forth in claim 8, wherein, said axial feeding means comprises pressure applying means proximate to said feeding station for pressing a wire against said portions of said groove, whereby, during rotation of said roller said portions of said groove apply an axial force to said wire to feed said wire axially towards said operating zone.

10. Apparatus as set forth in claim 9, said pressure applying means comprising a pressure roller.

11. Apparatus as set forth in claim 8, said loading station comprising guide slot means extending radially towards said roller and transversely of the axis of said roller, said guide slot means having opposed surfaces which are spaced apart by a distance which is sufficient to receive one of said wires whereby said wires can be stacked in said guide slot means and the lowermost wire of the stack will enter said groove during each rotation of said roller.

12. Apparatus as set forth in claim 8, said apparatus having sensing means proximate to said operatng zone for sensing the presence of a laterally conveyed and axially fed wire is said operating zone.

13. Apparatus as set forth in claim 12, said operating means comprising crimping means in said operating zone for crimping terminals onto wires which have been fed into said operating zone, and actuating means for actuating said crimping means, said actuating means being responsive to said sensing means and being effective to actuate said crimping means upon arrival of a wire in said operating zone.

14. Apparatus as set forth in claim 8, said apparatus having ejector means in said operating zone proximate to said operating means for ejecting said wires from said apparatus after performance of said operation on each wire.

15. Apparatus as set forth in claim 13, said ejector means comprising an ejector turret disposed between said roller and said operating means, said ejector turret mounted for rotation on an axis which extends towards said operating means, wire receiving recesses extending through said turret parallel to the axis thereof whereby a wire which is fed axially towards said operating means is disposed in one of said recesses, and means for indexing said ejector turret in a direction to move a wire in one of said recesses laterally away from said roller and said operating means.

16. An electrical lead feeding mechanism, comprising:

a roller having a cylindrical periphery provided with a helical groove, first means adjacent a first portion of said roller for feeding a plurality of electrical leads individually into engagement with said groove of said roller, second means for rotating said roller to transport said leads along said roller and to transport said leads simultaneously lengthwise and transversely of their lengths while engaged with said groove from said first portion of said roller to a second portion thereof, third means adjacent said second portion of said roller for sensing individual ones of said leads transported from said first portion of said roller to said second portion of said roller, an applicator adjacent said third means and being actuated by said third means for connecting electrical contacts to corresponding individual ones of said leads sensed by said third means, and an escapement station, said roller terminating at said escapement station whereby each of said leads is permitted to escape from said roller after connection thereto of an electrical contact.

17. The structure as recited in claim 16, and further including:

an idler roller mounted rotatably over said cylindrical roller and pressing said leads into engagement with said groove.

18. The structure as recited in claim 16, and further including:

a gate adjacent said third means, said roller upon rotation thereof transporting individual ones of said leads transversely into engagement with said gate, said roller upon rotation thereof transporting individual ones of said leads lengthwise while engaged on said gate toward said third means, said third means sensing individual ones of said leads transported lengthwise while engaged on said gate, and fourth means selectively disengaging said gate from individual ones of said leads sensed by said third means and connected with an electrical contact.

19. The structure as recited in claim 18, wherein, said fourth means pivots said gate to sweep individual ones of said leads connected with an electrical contact toward said escapement station.

* * * * *